United States Patent [19]

Stuart

[11] Patent Number: 4,784,610

[45] Date of Patent: Nov. 15, 1988

[54] ELECTRICAL CONNECTOR

[76] Inventor: Clifton F. Stuart, Rte. 1, Box 137, Lynnville, Tenn. 38472

[21] Appl. No.: 124,291

[22] Filed: Nov. 23, 1987

Related U.S. Application Data

[63] Continuation-in-part of Ser. No. 017,173, Feb. 20, 1987, abandoned.

[51] Int. Cl.[4] ..... H01R 13/44

[52] U.S. Cl. ..... 439/144; 174/67; 220/242; 439/160

[58] Field of Search ..... 439/142-145, 439/147, 159-160, 180; 174/47, 67; 220/242

[56] References Cited

U.S. PATENT DOCUMENTS

| | | | |
|---|---|---|---|
| 1,739,421 | 12/1929 | Savage | 439/144 |
| 3,888,513 | 6/1975 | Pilz et al. | 280/421 |
| 3,915,476 | 10/1975 | Burkle | 280/422 |
| 4,092,034 | 5/1978 | Becker | 280/420 |
| 4,196,307 | 4/1980 | Moore et al. | 174/47 |
| 4,366,965 | 1/1983 | Rhodes | 280/421 |
| 4,456,145 | 6/1984 | Frank | 439/142 |
| 4,475,751 | 10/1984 | Nishimura | 285/131 |
| 4,602,835 | 7/1986 | Bauer et al. | 439/160 |
| 4,624,472 | 11/1986 | Stuart et al. | 174/47 |
| 4,628,413 | 12/1986 | Speraw | 439/160 |

*Primary Examiner*—Gil Weidenfeld
*Assistant Examiner*—Paula A. Austin
*Attorney, Agent, or Firm*—Carothers & Carothers

[57] ABSTRACT

A plug and socket type electrical connector is provided with a cover assembly for protecting connector structure from the elements and structure for facilitating the selective electrical engagement and disengagement of the connector elements, preferably by providing cooperating locking elements on the cover assembly and the electrical plug as well as a rotary lever assembly which is operable to effect plug disengagement.

20 Claims, 5 Drawing Sheets

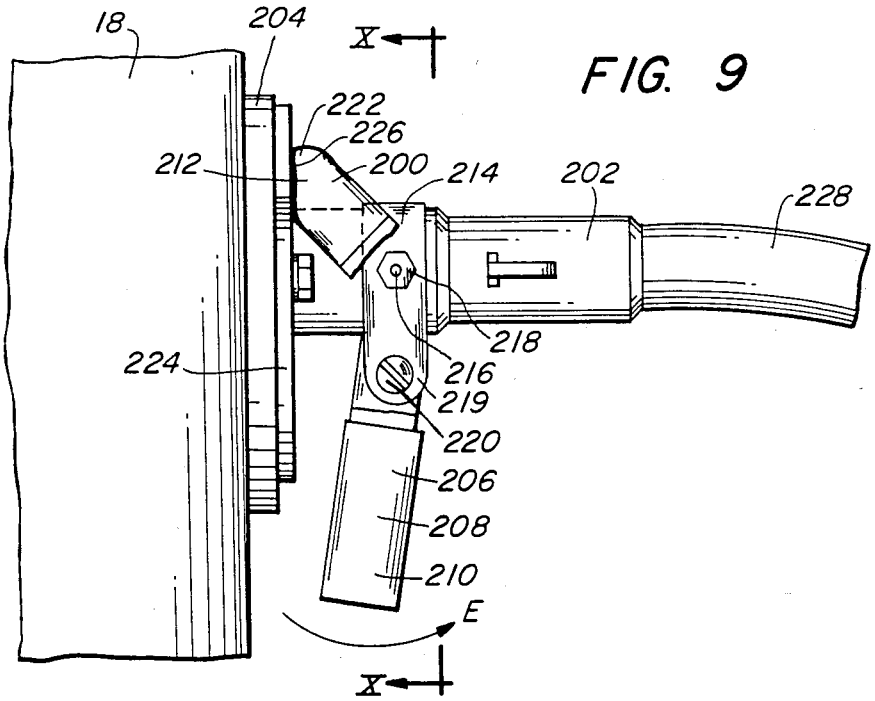
FIG. 9
FIG. 10
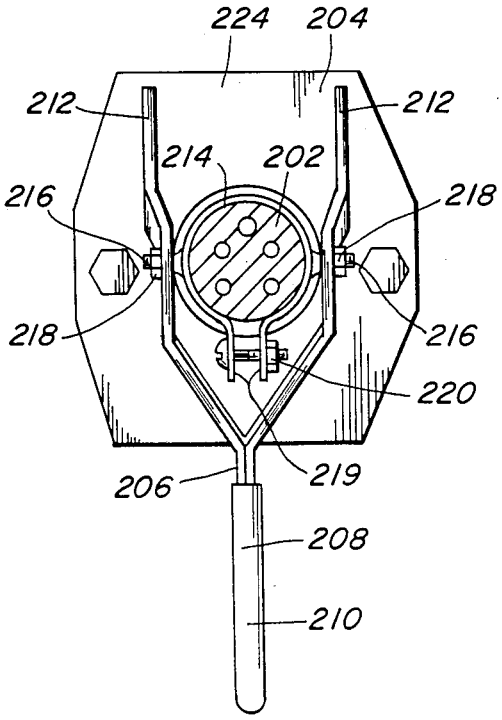

ELECTRICAL CONNECTOR

REFERENCE TO COPENDING APPLICATION

This is a continuation-in-part of copending application Ser. No. 017,173, filed Feb. 20, 1987 now abandoned.

BACKGROUND OF THE INVENTION

The present invention relates generally to couplings, and more particularly to couplings for electrical or fluid and electrical lines between adjacent coupled vehicles such as between the tractor and trailer portions of a road vehicle or between adjacent railway cars in a train. Therefore, it will be understood that although the invention is discussed primarily with regard to connections between the tractor and trailer or tandem trailers of a road vehicle, the invention is nevertheless applicable to other adjacent vehicles wherein electrical and/or fluid connections must be maintained therebetween.

In modern tractor-trailer combinations such as commonly utilized for over-the-road freight hauling, air lines and electrical lines must be connected between the tractor and the trailer to provide motive power for operation of the trailer brakes and electrical lights, respectively. Generally, and particularly in the American trucking industry, there are provided two air lines and one multiple conductor electrical line which typically must be independently coupled from the tractor to the trailer.

A tractor commonly picks up a trailer by backing up to it to engage the king pin whereby the tractor and trailer are mechanically hitched. Thereafter, the couplings at the free ends of the air lines and electrical lines are manually retrieved from a hanging position on the back of the tractor cab and are connected to respective couplings on the trailer. The conventional air line couplings are known as glad hand couplings and are operable somewhat in the manner of rotary bayonet type locks. The multiple conductor electrical line is connected by means of a conventional plug and socket arrangement. The socket typically comprises a recessed opening with a spring loaded hinged cover and a plurality of electrically conductive pins recessed in the socket opening. The plug member comprises an elongated body which is dimensioned to be interfitted within the socket opening and having respective pin receiving openings or sockets in the free end thereof for engagement with the electrically conductive pins of the socket member.

The coupling of the individual air lines and the electrical line commonly must be done independently of each other and often with some difficulty. For example, the conventional electrical plug and socket connectors, as above characterized, are frequently exposed to the elements and over time the electrically conductive pins and their mating elements will become corroded thereby making the coupling and decoupling process far more difficult than it need be and in some situations also dangerous. Further, since the electrical connectors typically must be prealigned manually for engagement, the initial alignment may vary considerably, thus causing undue wear on the electrical coupling elements during engagement and greater difficulty in engaging the elements for operation. Still further, the hanging weight of the cable connected to the plug causes misalignment during disconnection of the plug from the socket, thus resulting in further loosening and bending of the connector pins.

Often the pins of the socket element may become so badly deformed and/or misaligned from mishandling during connecting and disconnecting, and/or corroded from exposure to the elements, that it ultimately becomes very difficult if not impossible to engage and disengage the electrical plug and socket elements quickly and safely. The result may be that a plug often may not be fully engaged within its socket to the point of locking engagement or may be extremely difficult to disengage from the socket due to pin and/or receptacle corrosion. The increased difficulty of manual connector disengagement leads to further damage to the plug and socket members as the operator may well attempt to rock the plug member laterally or twist it about its axis while pulling on it to disengage the connector members. If the connectors suddenly and unexpected disengage under extreme pulling effort, the operator may well suffer injury to his arm. There have been numerous reports of injured elbows, specifically when an operator, in an attempt to disengage electrical connectors on the truck, pulls so hard that upon sudden release of the plug his elbow strikes the adjacent trailer. The confining space between tractor and trailer often is another factor which promotes undue electrical connector component wear as the limited space prevents the operator from standing directly behind the electrical connector to pull it straight out of the socket.

For the above and other reasons, practitioners in the art have constantly sought improvements in electrical and electrical/air hybrid connectors for connecting adjacent vehicles in a manner that will minimize undue connector component wear and risk of injury to the operator.

Among the patented art pertaining to such connectors are the following: U.S. Pat. Nos. 4,624,472; 4,475,751; 4,366,965; 4,092,034; 3,954,476; and 3,888,513. In particular, I am one of the inventors named in U.S. Pat. No. 4,624,472. That patent discloses various embodiments of a hybrid connector, including embodiments wherein a pivotal lever carried by the socket element is operable to draw the plug and socket members into operative engagement and to lock same in operative engagement by means of an over-center locking action.

BRIEF SUMMARY OF THE INVENTION

The present invention contemplates a novel and improved connector assembly for connecting either electrical or electrical and air lines between adjacent vehicles such as the tractor and trailer of an over-the-road freight hauling rig. The invention comprises, in one preferred embodiment thereof, cooperable plug and socket assemblies for use in making such connections, the socket including a hinged cap which serves to cover the socket opening and protect the electrical conductor pins therein from the elements when the plug is not engaged therein. The cover also incorporates a locking element and spring bias means which cooperate with a plug member to secure the plug member within the socket when the electrical connector elements are engaged. The socket also includes a pivoted release structure which cooperates with the engaged plug to facilitate disengagement thereof from the socket without any need to pull, twist or laterally shift the plug thereby reducing undue wear and the inherent risk of injury as above characterized. The plug disengagement structure permits an operator to disengage the plug by use of an axial pushing or pulling motion respectively toward or away from the wall-mounted socket assembly to achieve a mechanical advantage through a lever action afforded by the apparatus. The invention is of course described in far greater detail hereinbelow.

In another preferred embodiment of the invention, a pivoted release lever structure is carried by the plug member of a plug and socket connection, the release lever having a portion which upon actuation, cooperates with the flange or housing of the socket member to lift the plug member, thereby overcoming the hanging weight of the cable connected to the plug, and to withdraw the plug from the socket thus disconnecting the conductor pins from their respective receptacle openings.

It is therefore one general object of the invention to provide a novel and improved motive power connection assembly for selective connecting and disconnecting of motive power between adjacent vehicles.

It is a more specific object of the invention to provide a plug and socket type connector assembly including a disengagement structure which incorporates a pivotal lever structure that is operative to disengage the plug from the socket and thereby provide improved ease and safety for the operator in disengaging the plug from the socket element.

These and other objects and further advantages of the invention will be more readily understood upon consideration of the following detailed description and the accompanying drawings in which:

FIG. 9 is a side elevation, partially broken away, showing a further embodiment of the invention; and FIG. 10 is a sectional view taken on line X—X of FIG. 9

Figure 1:
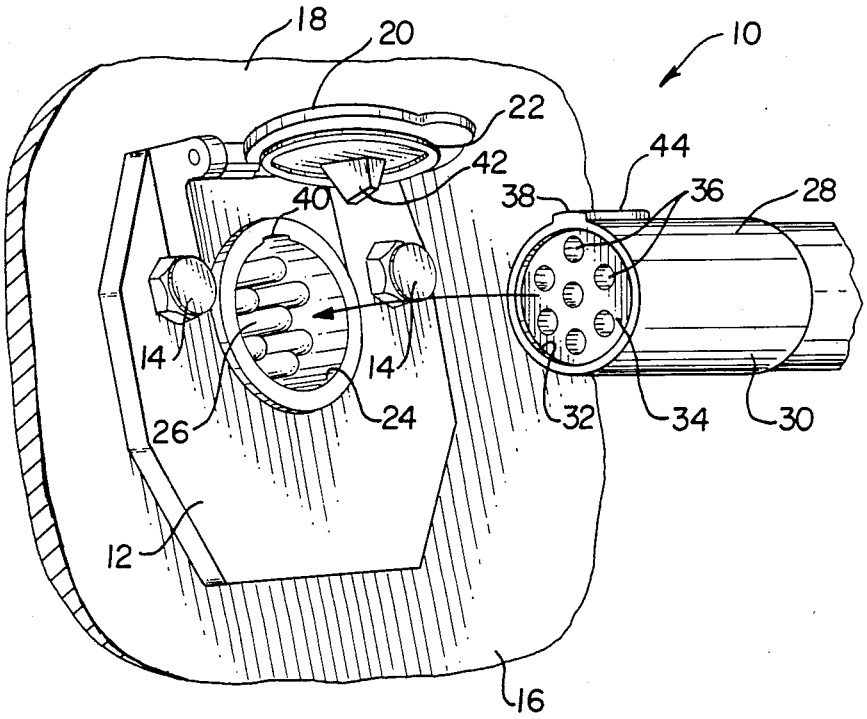
FIG. 1 (PRIOR ART)
FIG. 1 is a perspective view of a prior art plug and socket assembly over which the present invention improves.
Figure 2:
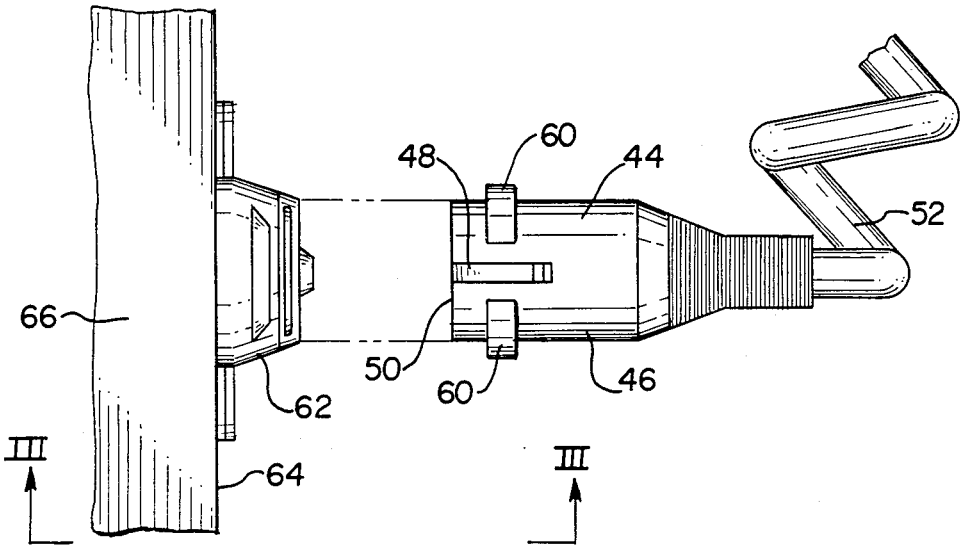
FIG. 2 is a top plan view of plug and socket elements of the present invention.

There is generally indicated at 10 in FIG. 1 a conventional plug and socket apparatus comprising a socket assembly 12 such as is commonly mounted by bolts 14 on the front or forward wall 16 of a trailer 18. Socket assembly 12 includes a hinged cap 20 having an annular sealing surface 22 which cooperates with a socket opening 24 to protect the interior of the socket opening 24 from the elements which could otherwise cause corrosion of electrical connector pins 26 which are recessed within socket opening 24.

A plug member 28 comprises and elongated cylindrical body 30 having an open free end 32 within which there resides a female electrical connector element 34 having plural coaxial openings 36 positioned to receive pins 26 upon insertion of plug 28 into socket opening 24. An electrical power source (not shown) is thereby connected to a load (not shown) in the conventional manner via the apparatus 10.

An elongated key 38 extends axially upon the exterior periphery of plug body 30 to cooperate with a mating longitudinal slot 40 formed in opening 24 to prealign and guide plug 28 during insertion thereof into socket opening 24. Cap 20 includes a boss 42 which cooperates with a rearward end 44 of key 38 to lock plug 28 in engagement within socket opening 24. For this purpose cap 20 may commonly be spring biased toward a closed position, as is well known.

The above described elements of an electrical connector apparatus are entirely conventional and further detailed description thereof thus is believed unnecessary for an understanding of the invention. For further description of such conventional elements reference may be had to the above cited U.S. patent art.

Referring now to FIGS. 2-6, applicant's invention comprises a plug 44 comprising an elongated cylindrical body 46 with an axially extending key 48 and a free end 50 similar in many respects to corresponding elements above described. Of course, the end of plug 44 opposite free end 50 is connected to an electrical cable 52 whereby electrical power is delivered from a tractor or similar vehicle (not shown) to plug 44.

Figure 6:
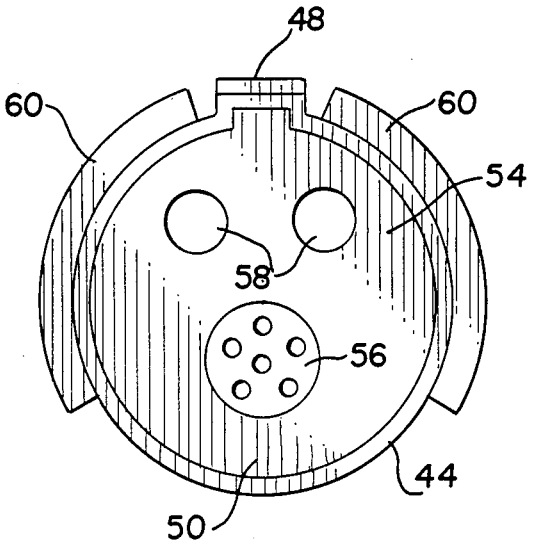
FIG. 6 is an end elevation taken on line VI—VI of FIG. 3.

According to applicant's invention, it will first be noted from FIG. 6 that plug 44 may provide for common connection of both fluid and electrical power sources through a single hybrid connector. For example, the plug in FIG. 6 is seen to have installed within the open end 50 thereof a connector element 54 for connection of electrical power via a multiple pin female insert 56 and fluid power via one or more fluid connection ports 58. For further disclosure of such hybrid connector, reference is made to the above-cited U.S. Pat. No. 4,624,472.

Plug 44 also incorporates a pair of circumferentially extending bosses 60 (FIG. 2) which encompass at least lateral side portions of body 46 to either side of key 48. Bosses 60 are spaced longitudinally from free end 50 to permit full engagement of plug 44 within a socket 62 which is mounted on the front or forward wall 64 of a trailer 66.

Figure 3:
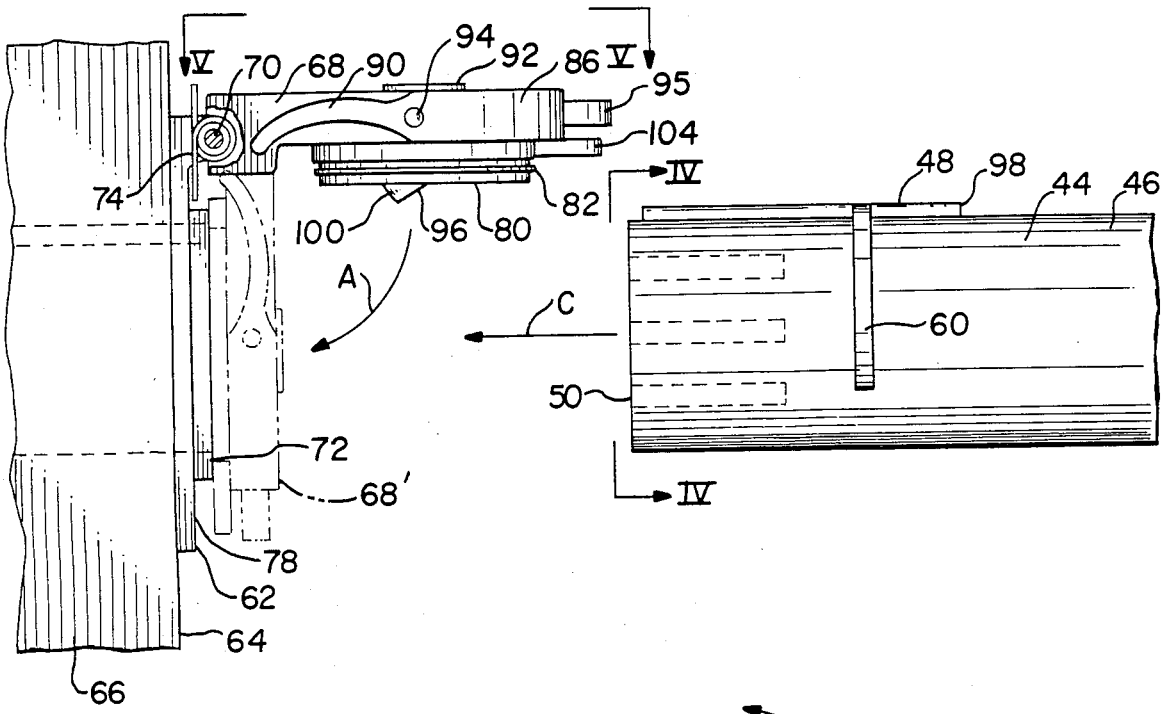
FIG. 3 is a fragmentary side elevation taken on line III—III of FIG. 2 and with portions thereof broken away to show details of the invention.
Figure 5:
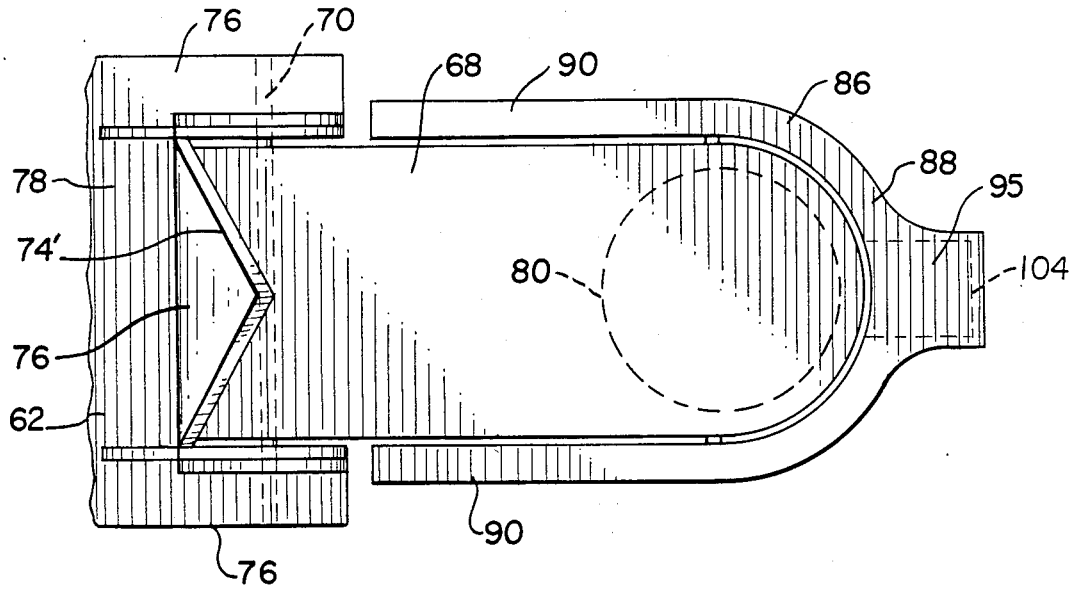
FIG. 5 is a top plan view taken on line V—V of FIG. 3.

Socket 62 includes a hinged cap 68 which is mounted on a pivot axis 70 above the socket opening 72 for pivotal movement between an open position as shown in solid line in FIG. 3, and a closed position shown at 68' in FIG. 3. Cap 68 is biased in the direction of arrow A by a biasing spring 74 which encompasses portions of pivot axis 70. An alternative spring 74' is shown in FIG. 5 for biasing the cap 68 downwardly. Also shown in FIG. 5 is the hinge arrangement of cap 68 in that pivot axis 70 passes through aligned bores in an end portion of cap 68 which resides between spaced apart, outwardly projecting ears 786 of a base portion 78 of socket 62.

On further reference to FIGS. 3 and 5 it will be seen that cap 68 also comprises a generally circular socket closing portion 80 including a sealing structure such as an O-ring 82 or alternatively an annular sealing surface dimensioned for sealing engagement with the socket opening 72 to close the socket opening 72 when cap 68 is in the position 68'. As mentioned, spring 74 biases the cap toward its closed position and thereby maintains sealed closure of socket opening 72 to protect elements with the socket opening 72 from the environment when plug 44 is disconnected therefrom.

Cap 68 also comprises a plug disengagement structure in the form of a generally horeshoe-shaped pivoted member 86 having a curved end portion 88 which encompasses the outermost end of the main body of cap 68, and inwardly projecting legs 90 which project along either side of the main body of cap 68 toward pivot axis 70. A biasing spring 92 (FIG. 3) encompasses a pivot axis 94 by which member 86 is pivotally affixed with respect to the main body of cap 68 so as to continuously bias member 86 toward a neutral or unactuated position as shown in FIG. 3.

A handle or push tab 95 projects outwardly of portion 88 to permit rotation of member 86 in the direction of arrow B (FIG. 4) against the bias of spring 92. With this motion, legs 90 swing downwardly to disengage plug 44 from socket 62 as described hereinbelow.

Cap 68 further comprises a locking boss 96 projecting from the underside of cap 68 within the perimeter of sealing portion 80. Boss 96 is engageable with a rearwardmost end 98 of key 48 to retain plug 44 in electrical engagement within socket 62. Spring 74 biases boss 96 against key end 98 to provide firm retention; however, the sloped forward surface 100 of boss 96 permits the engagement of boss 96 with key end 98 to be overridden upon application of axial effort to extract plug 44 from socket 62.

In practice, the invention is operable as follows. For connection of plug 44 in operative engagement within opening 72 of socket 62, cap 68 first must be lifted from position 68' to clear socket opening 84 and thereby permit manual insertion of plug 44 into socket opening 84 as indicated by arrow C in FIG. 3. A handle portion 104 is provided on the main body of cap 68 adjacent to handle portion 95 to permit rotation of cap 68 against the bias of spring 74 without also causing relative rotation of plug disengagement member 86 with respect to cap 68. With plug 44 fully inserted in socket opening 84, cap 68 is released to permit spring 74 to urge boss 96 into retaining engagement with key end 98. Plug 44 thus will be retained in operative engagement with socket 62.

Figure 4:
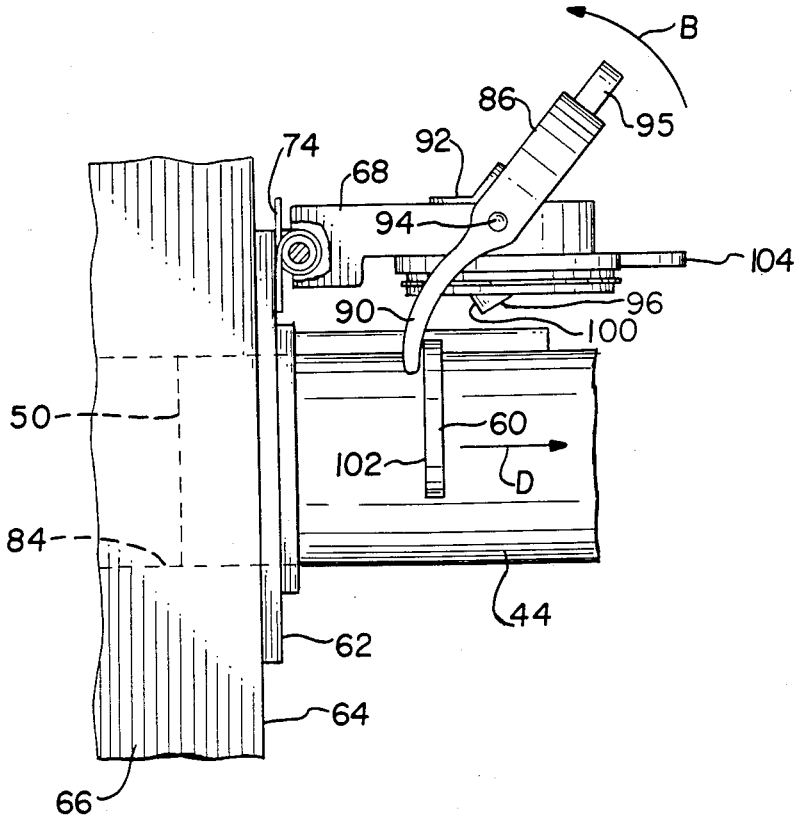
FIG. 4 is a fragementary side elevation similar to FIG. 3 showing the plug and socket members engaged and the disengagement apparatus in operation.

FIG. 4 illustrates the disengagement of plug 44 from socket 62 at an interim point in the disengagement process. It will be understood that when plug 44 is fully engaged within socket 62, bosses 60 are positioned with respect to pivotal member 86 such that legs 90 will engage forward surfaces 102 of bosses 60 upon rotation of member 86 in the direction indicated by arrow B. Accordingly, an operator may push upward and inward on handle portion 95 to rotate member 86 against the bias spring 92 thereby bringing legs 90 into forceful engagement with surfaces 102 of bosses 60. Further rotary movement of member 86 will push bosses 60 outwardly, and thus the plug 44 outward, in the direction of arrow D to disengage plug 44 from socket 62.

It is noted that typically only an initial portion of the disconnection movement has presented difficulty in the past. Therefore, it is contemplated that the rotary movement of member 86 and the cooperation of legs 90 with bosses 60 need not serve to fully disengage plug 44 from socket 62. It will suffice that these elements be cooperable to move plug 44 far enough in the direction D that only nominal further manual pulling effort will be required to fully disengage the plug 44 from socket 62.

The proportionate lengths of the lever provided by the portions of member 86 extending in opposite directions from pivot axis 94 are proportioned to offer a mechanical advantage to the operator to thereby significantly reduce the magnitude of force necessary to initiate disconnection motion of plug 44 in the direction D.

Of course, it will be appreciated that when no rotary force is applied to member 86, spring 92 will return it to its neutral position as shown in FIG. 3 where it will be clear of the plug 44 when the same is engaged within socket 62. Likewise, in the neutral position member 86 will clear socket 62 and the socket opening 72 therein when the cap is in position 68' to provide for sealed closure of the socket opening 84.

In another modification, the pivotal member 86 may include a portion of the body of cap 86 which incorporates boss 96 such that upon rotation of member 86 to disengage plug 44 from socket 62, boss 96 will be simultaneously lifted out of retaining engagement with key end 98.

Figure 7:
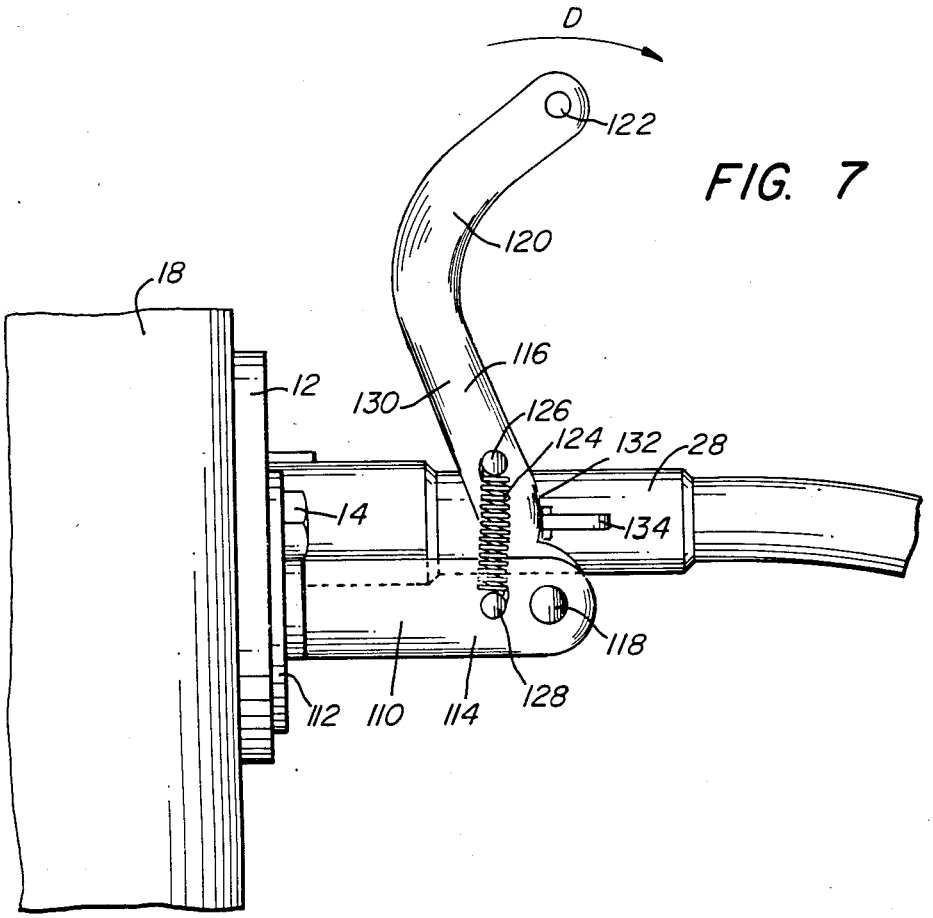
FIG. 7 is a side elevation of an alternative embodiment of the invention.
Figure 8:
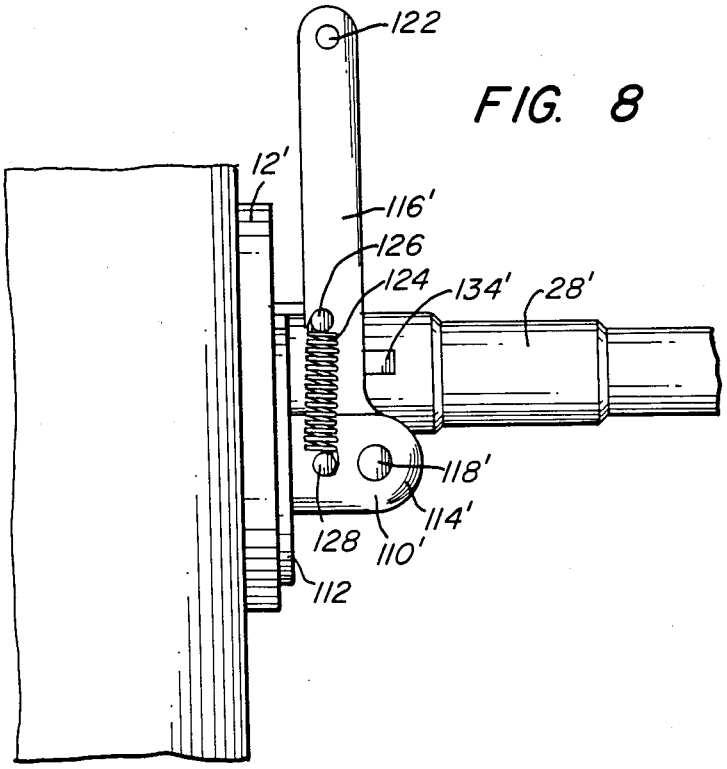
FIG. 8 is a side elevation of another alternative embodiment of the invention.

In FIGS. 7 and 8 there are shown two alternative embodiments of the invention, which are described hereinbelow with further reference to FIG. 1. In FIG. 7, a conventional connector comprising a socket assembly 12 mounted on a trailer 18, and cooperating plug 28, just as in FIG. 1, are shown. For purposes of clarity, cap 20 is not shown in FIGS. 7 and 8 but it will be understood to comprise the usual cap structure of such conventional plug and socket connectors as above described with reference to FIG. 1.

A plug disengagement bracket assembly 110 comprises a mounting plate portion 112 that is secured adjacent socket 12 by bolts 14 so as to straddle socket opening 24. A pair of laterally spaced apart, elongated support members 114 project outwardly of mounting plate portion 112 from laterally opposite sides of socket opening 24 in a manner to provide lateral clearance therebetween for insertion of plug 28 into socket opening 24.

Adjacent the outermost end of each member 114 a lever member 116 is pivotally affixed as by a pivot axis means 118 (e.g. a bolt or rivet) for free rotation with respect to the respective members 114. Each lever 116 extends generally upwardly of the respective member 114, preferably incorporating a curved portion 120 which curves away from socket assembly 12 to thereby provide clearance from trailer 18 for a user to grasp a handle portion 122 that extends laterally between and is affixed to the respective levers 116 adjacent their free ends.

A tension spring 124 extends between and is affixed to retention pins 126, 128 that are affixed, respectively, to one of levers 116 and the respective support member 114. Spring 124 continuously biases the disengagement handle assembly 130, which is comprised of both levers 116 and the handle portion 122, toward a rest or inactive position as shown.

A lower portion of each lever 116 includes a formed pocket 132 that is configured to receive a respective one of the pulling dogs 134 that are commonly included on the laterally opposite sides of conventional plugs 28. The pulling dogs 134 have typically been intended to assist an operator in disengaging the plug 28 from socket opening 24 by providing structure over which the operator may hook his fingers for a firm grip to facilitate the pulling required for manual plug disengagement from the socket. To this end, such pulling dogs typically are spaced from the free end portion of the plug that is received into the socket opening 24.

For purposes of the instant invention, the operator grips handle 122 and pulls in the direction indicated by arrow D whereby pocket 132 engage pulling dogs 134 to forceably eject plug 28 from socket opening 24. As in the case of the above-described embodiments, the described structure is intended primarily as an initial assist to break the tight connection between the plug and socket. Therefore, after initial assisted movement of the plug outwardly of the socket, with the assistance of apparatus 110, the plug 28 may be easily removed from socket opening 24 in the conventional manner.

As noted, the apparatus 110 is operative by engagement of conventionally provided pulling dogs 134. As such, the assembly 110 is intended primarily as an aftermarket apparatus for retrofit on conventional plug and socket connectors already in service.

The embodiment shown in FIG. 8 comprises a disconnecting assembly 11O' which is similar in many salient respects to the above-described embodiment of FIG. 7. However, the FIG. 8 embodiment constitutes an original-equipment device which is not intended to accommodate conventional plug and socket assemblies. Accordingly, mounting plate 112 carries foreshortened support members 114' as the members 114' need not be elongated as in the FIG. 7 embodiment to reach a point adjacent the pulling dogs 134. Also, in lieu of mounting plate 112, the members 114' may alternatively be support ears that are an integral part of the socket assembly 12'. For example, the socket assembly 12' may consist of a base portion as shown in FIG. 1 and support ears 114' as a single casting.

Referring further to Fig, 8, apparatus 11O' also includes lever members 116' pivotally affixed to ears 114' as by pivots 118', and handle 122 extending between lever members 116' adjacent their free ends. Also included is the spring 124 connected between retention pins 126 and 128 as above-described with reference to FIG. 7. The plug member 28' may be similar in most salient respects to conventional plugs but instead of pulling dogs 134, it is provided with engagement bosses 134' located preferably much closer to the free end of plug 28' than are the pulling dogs 134 of conventional plugs.

It is preferable that the point of contact between elements of plug 28' and the disengagement apparatus 11O' be as close as possible to socket 12' to minimize the possibility of misalignment and possible binding which in prior plug and socket structures have been one cause of cumulative damage and ultimate failure. The placement of disengagement bosses 134' as close as possible to the free end of plug 28' accomplishes this and in addition simplifies the design of disengagement apparatus 11O', by comparison to the alternative structure therefor shown in FIG. 7.

Referring to FIGS. 9 and 10, there is shown another presently preferred embodiment of the instant invention, according to which a pivoted lever apparatus 200 is operable to extract or disconnect a plug 202 from a socket 204, both of which may be similar in all salient respects to the corresponding plug and socket members described hereinabove. For this reason, it is believed further detailed description of the plug and socket members 202, 204 is unnecessary for an understanding of the embodiment of the invention shown by FIGS. 9 and 10.

Lever apparatus 200 comprises a pivoted lever assembly 206 having a handle portion 208 with a flexible or pliable cover 210 of, for example, vinyl plastic or rubber. Adjacent to handle portion 208, lever assembly 206 is bifurcated to form a pair of laterally spaced apart legs 212 which are spaced sufficiently apart to receive therebetween a band clamp 214. Legs 212 are pivotably affixed to clamp 214 above lever 206 as by pivot pins 216 extending laterally to either side of clamp 214 and passing through corresponding apertures in the respective legs 212.

To retain legs 212 in pivoted engagement on respective pins 216, any suitable expedient may be employed. For example, pivot pins 216 may be the threaded ends of machine screws having threaded nuts 218 engaged thereon. Any suitable expedient may be employed to retain nuts 218 in engagement on pins 216. For example the exposed ends of pins 216 may be upset, or nuts 218 may be crimped. Band clamp 214 is of an internal diameter to permit the same to encircle plug 202, and includes a pair of spaced apart fastener flanges 219 which receive a threaded screw and nut fastener assembly 220. Upon tightening of screw and nut assembly 220 in retention flanges 219, with band clamp 214 engaged about the perimeter of a plug 202, the band clamp 214 is tightened into rigid and encompassing engagement about plug 202 such that lever 206 may be pivoted about pivots 216 to be operable for disengagement of plug 202 from socket 204 as follows.

It will be seen from FIG. 9 that the laterally spaced legs 212 of lever 206 are angled at approximately the location where lever 206 is pivotally affixed to pivot pins 216. Accordingly, a free end portion 222 (FIG. 9) of each leg 212 extends from pivot 216 upwardly and toward the mounting flange 224 of socket 204 to engage the same at a point above the socket opening into which plug 202 is inserted. With leg portion 222 engaging socket flange 224, handle portion 208 may extend generally vertically downward, and preferably converges slightly toward trailer 18 on which socket 204 is mounted. This leaves ample free space for manipulation of handle 208 such that pulling thereof away from trailer 18 disengages plug 202 from socket 204.

Specifically, handle 208 provides sufficient space for an operater to grasp hand grip 210 and pull in the direction indicated by arrow E to disengage plug 202. Such pulling causes the outermost end 226 of each leg portion 222 to forcefully engage mounting flange 224 whereby further movement of handle 208 in the direction of arrow E causes leg portions 222 to act against flange 224 and thereby eject plug 202 from socket 204.

Coincidently with initial application of disengagement force to handle 208, the frictional engagement of leg ends 226 with mounting flange 224 cause a vertically upward lifting action to be imposed upon plug 202 prior to any axial movement thereof toward a disengaged position with respect to socket 204. The vertically upward lifting action offsets, in part or entirely, the gravitational drag exerted by the weight of cable 228 on plug 202. This weight, in prior art connectors, has been one common cause of plug and socket degradation and failure as connection and disconnection were invariably accomplished under conditions of misalignment resulting from the weight of the cable on the plug element. With the present invention, the plug disengagement operation is preceded by the described lifting action which serves to align the plug 202 properly with respect to the socket 204 prior to axial movement to disengage the same from the socket. This result is achieved in part by providing the contact point for leg end portions 226 with mounting flange 224 generally above the socket opening into which plug 202 is received, and in part by friction between leg ends 226 and flange 224, or other suitable mechanism, which opposes, to a limited degree, downward sliding motion of leg ends 226 on flange 224 in response to movement of handle 208 in the direction of arrow E.

Of course it will be appreciated that the invention as above described with reference to FIGS. 9 and 10 pertains to a retrofit apparatus for use in conjunction with conventional prior art plug and socket arrangements. It is also contemplated, as an alternative, that lever assembly 200 could be part of the original equipment plug apparatus rather than added on. Specifically, the housing of plug 202 could be manufactured with integral pivot pins 216 to receive legs 212 of lever apparatus 200 whereby the necessity of band clamp 214 would be eliminated and the invention would function precisely as above described with reference to the FIG. 9 and 10 embodiments.

According to the description hereinabove there is provided by the instant invention a novel and improved power connection apparatus for connecting a power source or multiple power sources in a first vehicle with respective loads in an adjacent vehicle. The invention contemplates structures for protection of connection elements, retention of operative engagement between connection elements, and improved modes of disconnection or disengagement of the connector elements, these functions being effected by an apparatus of combined structural elements unknown heretofore in the art.

Of course I have contemplated numerous alternative and modified embodiments of the invention which most certainly would occur to others versed in the art once apprised of my invention. For example, the specific geometry and structural design of the various elements which make up the cap assembly 68 may be varied within a wide latitude of design. Furthermore, the invention is applicable to a wide variety of connection devices and is not limited to those conventionally applied to road vehicle tractor-trailer combinations. Accordingly, it is my intent that the invention be construed as broadly as permitted by the scope of the claims appended hereto.

I claim:

1. A connector apparatus for connecting a motive power source to a load comprising:

a plug means adjacent one end of a power conveying conduit;

a mating connector adapted for selective engagement and disengagement of said plug means in motive power conveying relationship therein;

said mating connector including a mounting flange means which is cooperable with fastener means for mounting said mating connector adjacent a surface;

disengagement means carried by said mating connector and selectively movable with respect thereto into operative engagement with said plug means when said plug means is engaged with said mating connector;

said disengagement means including pivotally movable means which is selectively movable with respect to said mating connector in contact with said plug means to effect disengagement of said plug means from said mating connector; and spring bias means continuously biasing said pivotally movable means in a pivotal direction opposing the direction of pivotal motion thereof which effects such disengagement.

2. The connector apparatus as claimed in claim 1 additionally including a cap means which is movably retained with respect to said mating connector for selective movement between a closed position and a clear position, said cap means being selectively movable from said closed position to said clear position to permit said plug means to be operatively engaged with said mating connector.

3. The connector apparatus as claimed in claim 2 wherein said cap means is pivotally retained with respect to said mating connector for pivotal movement between said closed and clear positions.

4. The connector apparatus as claimed in claim 3 wherein said cap means additionally includes retention means cooperable with said plug means to retain said plug means in motive power conveying engagement within said mating connector when said cap mean is in said clear position.

5. The connector apparatus as claimed in claim 4 additionally including other spring bias means for continuously biasing said cap means toward said closed position.

6. The connector apparatus as claimed in claim 5 wherein said disengagement means includes a pair of elongated legs which extend adjacent opposite lateral sides of said plug means when said plug means is engaged within said mating connector, and are disposed with respect to said cap means such that said legs are positionable in a first position to permit movement of said cap means to said closed position, and are selectively movable from said first position, when said cap means is in said clear position, to engage respective portions of said plug means and thereby effect such disengagement of said plug means from said mating connector.

7. The connector apparatus as claimed in claim 6 wherein said disengagement means comprises a bifuricated member which is pivotally affixed with respect to said cap means such that said pair of elongated legs extend adjacent laterally opposite sides of said cap means.

8. In a plug and socket assembly for conveying motive power between a power source and a load the combination comprising:

a plug means;

a socket means having an opening adapted to receive said plug means in operative engagement therein;

closure means selectively movably retained with respect to said socket means for movement between a closed position and a clear position;

said closure means being selectively movable to said closed position, when said plug is disengaged from said socket, to position a sealing means adjacent one side thereof in sealing engagement with said opening and thereby isolate motive power conveying elements located within said opening from the exterior environment, and being selectively movable to said clear position to permit insertion of said plug into said opening; and plug disengagement means movably retained by said closure means and selectively movable with respect thereto into engagement with portions of said plug to effect disengagement of said plug from said socket opening.

9. The combination as claimed in claim 8 wherein said closure means includes a cap means which is pivotally retained with respect to said socket for selective pivotal movement between said closed and said clear positions and is continuously biased toward said closed position.

10. The combination as claimed in claim 9 wherein said plug disengagement means includes a pair of laterally spaced elongated legs which are pivotally retained with respect to respective opposite lateral sides of said cap means for mutual pivotal movement in the direction axially outward of said socket means to engage said portions of said plug and thereby effect disengagement of said plug from said opening.

11. The combination as claimed in claim 10 wherein said portions of said plug include a pair of radially projecting boss means positioned with respect to peripheral portions of said plug for cooperation with the respective said laterally spaced elongated legs.

12. The combination as claimed in claim 11 wherein said plug disengagement means further includes a connecting element which joins said pair of legs and forms an actuating means which is manually actuated to pivot said elongated legs into engagement with said radially projecting bosses and to apply forceful impetus thereto to disengage said plug from said socket opening.

13. In a plug and socket assembly for conveying motive power between a power source and a load, the combination comprising:

a plug means;

a socket means having an opening adapted to receive said plug means in operative engagement therein;

one of said plug and said socket means having pivot axis means and an elongated plug disengagement means with a pivot connection to said pivot axis means and operable upon pivotal movement thereof to disengage said plug means from said socket means by moving said plug means axially outward of said socket means;

said elongated plug disengagement means including a handle portion spaced longitudinally in one longitudinal direction from said pivot connection and a pair a of laterally spaced legs spaced longitudinally in the opposed longitudinal direction from said pivot connection; said plug disengagement means being pivotally movable about said pivot axis means with said plug means received between said legs;

and contact means cooperable with said legs upon pivotal movement thereof to effect such disengagement of said plug means from said socket means.

14. The combination as claimed in claim 13 wherein said disengagement means is carried by said plug means and said contact means as carried by said socket means.

15. The combination as claimed in claim 14 wherein said legs include free end portions for engaging said contact means.

16. The combination as claimed in claim 15 wherein said contact means is located vertically above the elevation of said pivot axis means and laterally spaced therefrom such that said legs extend upwardly and at an angle to the vertical when said free ends first engage said contact means with said plug means engaged within said socket means.

17. The combination as claimed in claim 16 wherein said free ends are cooperable with said contact means upon initiation of forceful contact therebetween, with said plug means engaged within said socket means, to provide a vertical lifting influence for aligning said plug means with said socket means coincidentally with disengagement of said plug means from said socket means.

18. In a plug and socket assembly for conveying motive power between a power source and a load, a disengagement apparatus cooperable therewith to effect prealigned disengagement of such a plug from such a socket comprising:

an elongated, rigid means having a handle portion adjacent one longitudinal end thereof and a bifurcated portion comprised of a pair of laterally spaced apart legs adjacent the opposite longitudinal end thereof;

mounting means received between the said laterally spaced legs;

pivot axis means pivotally connecting said mounting means to said elongated means intermediate said longitudinal ends;

said mounting means being adapted to mount said elongated means on such a plug adjacent the portion thereof which is inserted into such a socket in operative engagement therewith;

and retention means cooperable with said mounting means to rigidly, releasably secure said mounting means with respect to such a plug member.

19. The apparatus as claimed in claim 18 wherein said mounting means includes a circumferential clamp received between said laterally spaced legs and including radially outwardly projecting pivot axis means carried by said circumferential clamp and extending in opposite radial directions therefrom.

20. The apparatus as claimed in claim 19 wherein said securing means includes selectively adjustable tightening means for drawing said circumferential clamp into tight circumferential engagement about such a plug member.

* * * * *